United States Patent [19]

Martin et al.

[11] 4,126,258

[45] Nov. 21, 1978

[54] CLAMP NAIL DRIVING TOOL

[75] Inventors: Charles R. Martin, Cincinnati, Ohio; Francis J. Kramer, Edgewood, Ky.; Thomas E. Warman, Williamsburg, Ohio

[73] Assignee: Senco Products, Inc., Cincinnati, Ohio

[21] Appl. No.: 823,943

[22] Filed: Aug. 12, 1977

[51] Int. Cl.[2] ..... B25C 1/00

[52] U.S. Cl. ..... 227/8; 227/120; 227/148; 227/109

[58] Field of Search ..... 227/109, 110, 119, 120, 227/148, 8

[56] References Cited

U.S. PATENT DOCUMENTS

| | | | |
|---|---|---|---|
| 2,900,638 | 8/1959 | O'Kelley | 227/120 |
| 2,994,878 | 8/1961 | Abrahamsen | 227/120 |
| 3,042,924 | 7/1962 | Frostad | 227/120 |
| 3,693,863 | 9/1972 | Black | 227/148 |
| 3,720,364 | 3/1973 | Maestri | 227/109 |

*Primary Examiner*—Granville Y. Custer, Jr.
*Attorney, Agent, or Firm*—Melville, Strasser, Foster & Hoffman

[57] ABSTRACT

A pneumatic tool for driving clamp nails, having a single nose piece making possible the driving of clamp nails into the outside corner of a miter joint, or the inside corner of a miter joint, and having a plate which may be adjusted to position the nose piece at any angle from 45° to 30° off the vertical centerline of the tool. When set at the 30° angle, the nose piece is in the optimum position to drive a clamp nail into an inside right angled butt joint. A safety is provided having a configuration like the nose piece. The tool is provided with a magazine for a stick of clamp nails, and an adjustable rail in the magazine makes it adaptable to clamp nails of different sizes. The guide body through which the clamp nails are fed into position below the drive is provided with a configuration which makes it impossible to feed clamp nails if the stick is inserted into the magazine upside down.

9 Claims, 25 Drawing Figures

30
35
36
38
40
42
43
50
51
54

CLAMP NAIL DRIVING TOOL

CROSS REFERENCE TO RELATED APPLICATION

The tool of this application is especially useful for driving clamp nails disclosed in copending application Ser. No. 576,882 filed May 12, 1975 in the names of Kramer et al, now U.S. Pat. No. 4,058,047 dated Nov. 15, 1977.

BRIEF SUMMARY OF THE INVENTION

In said copending application, a novel clamp nail is disclosed which overcomes many, if not most, of the disadvantages of prior art clamp nails. Traditional clamp nails comprise a channel-like structure which is tapered. There is a web and on each side of the web are upstanding flanges. The web is wider at the leading end than at the trailing end and the clamp nail is driven into the joint wide end first. Thus, when the clamp nail is driven in it draws the two pieces of wood to be joined together. Many of the prior art clamp nails have necessitated a sawed kerf for proper installation.

It has been found that joints produced with a conventional clamp nail are tighter at the trailing end of the fastener than at the leading end. The joints often appear well clamped when viewed from the direction the fastener was inserted, but when the joint is turned over it can be seen that the joint really is not well clamped.

The clamp nail of said copending application is provided with flanges which over a major portion of the clamp nail are parallel. At the leading end of the clamp nail there is a tapered portion and there may be a relatively short parallel portion ahead of the tapered portion. The result of this structure is that the short tapered portion has the effect of pulling two members to be clamped together and the major portion in which the flanges are parallel makes the joint uniform throughout the length of the clamp nail.

Attempts have been made in the prior art to provide a particular magazine, guide body and nose piece which could be attached to a conventional pneumatic stapling or nailing machine in place of the standard magazine, guide body and nose piece, and various attempts have been made to form the clamp nails into a stick which could be inserted into such a magazine. Such arrangements have generally been clumsy and jamming of the clamp nails was common. Prior art devices were not equipped with any sort of safety to prevent the actuation of the device when the tool was not in position against a work piece.

In prior art tools, it was necessary to provide a plurality of nose pieces for the different types of work encountered. A different nose piece was required for an outside miter, for an inside miter, for an inside right angled butt joint as well as for any type of butt joint other than a right angled butt joint. This of course slowed down production because the tool had to be modified for each different type of work.

The present invention provides a unitary tool including a magazine and provided with a safety device to prevent actuation when the tool is not in position against a work piece. The safety device may be as disclosed in the Juilfs et al U.S. Pat. No. 3,278,105, or in the Becht et al U.S. Pat. No. 3,278,106. These safety devices require that the tool be placed against the work piece before the trigger may be actuated.

The nose piece of the tool has a W-shaped configuration making it possible to use the nose piece on an inside or outside miter joint. An adjustable plate is provided by means of which the angle of the tool with respect to the work may be made to vary between 30° and 45°.

Because of the shape of the clamp nail (i.e. the fact that it is wider at the leading edge than at the trailing edge) it is necessary to insure that the stick of nails is inserted in the magazine right side up. In spite of markings on the stick, it is possible to put the stick in wrong side up and therefore the present invention provides positive means to prevent improper insertion of the nail stick. This is accomplished by a configuration in the guide body where the clamp nails are fed from the magazine into the path of the driver. This prevents the clamp nails from being fed if the stick of clamp nails is upside down in the magazine.

The magazine of the present tool is also provided with means whereby the magazine can accept clamp nails of different sizes by means of an adjustable rail in the magazine.

DETAILED DESCRIPTION

Figure 1:
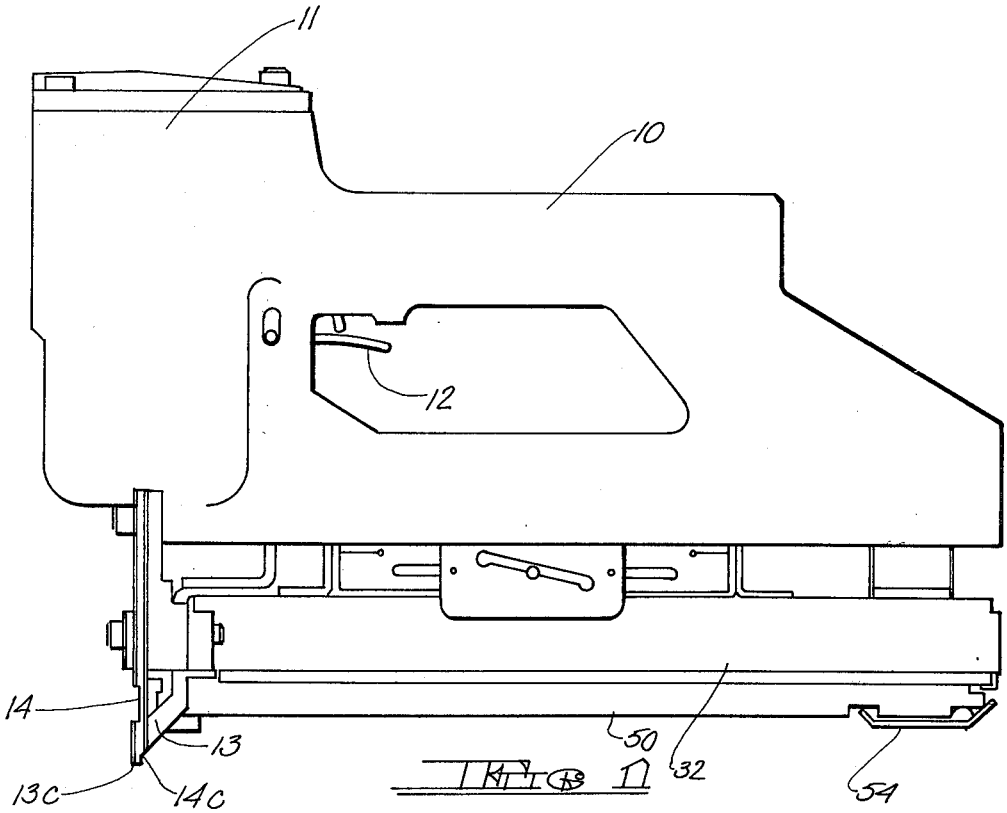
FIG. 1 is a side elevational view of a tool according to the present invention.

The tool in its entirety is shown in elevation in FIG. 1. The tool has a handle portion 10, a cylinder portion 11 within which a piston may be caused to execute a stroke when the trigger 12 is actuated. The tool is of course connected to a source of air under pressure. The valving and internal structure of the tool will not be described because tools such as this are well known. The tool may be as disclosed in the Rothfuss et al U.S. Pat. No. 3,808,620 dated May 7, 1974 or the Juilfs U.S. Pat. No. RE. 26262, and will preferably be provided with a safety foot 13 which may operate as disclosed in the Becht et al U.S. Pat. No. 3,278,106 or the Juilfs U.S. Pat. No. 3,278,105.

Figure 11A:
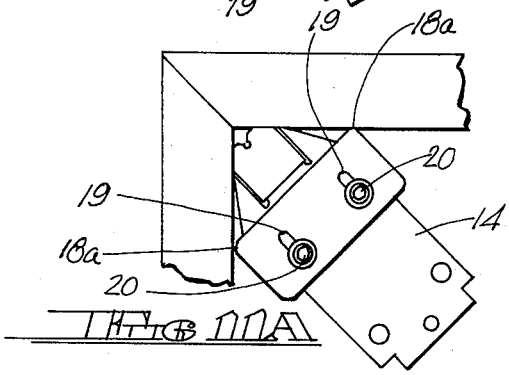
FIG. 11A shows the use of the nose piece to clamp nail an inside 45° miter joint.
Figure 11B:
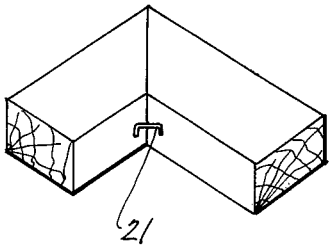
FIG. 11B is a perspective view of the clamp nailed joint.

Referring more particularly to FIGS. 8A through 8G, the nose piece comprises a guide body 14 and a backing plate 15. It will be noted that the work-contacting portion of the guide body has a "W" configuration. The outer surfaces **14*a* are disposed at right angles to each other and at 45° to the centerline of the tool. This makes the nose piece suitable for driving a clamp nail into the outside of a 45° miter joint as shown in FIGS. 11A and 11B**.

Figure 9A:
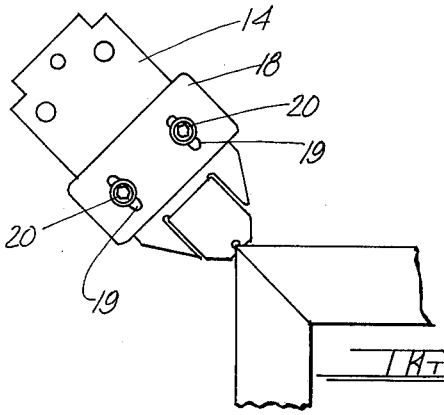
FIG. 9A is a view showing the nose piece positioned to drive a clamp nail into the outside of a 45° miter joint.
Figure 9B:
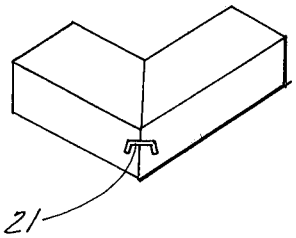
FIG. 9B is a perspective view of the outside clamp nailed 45° miter joint.
Figure 12A:
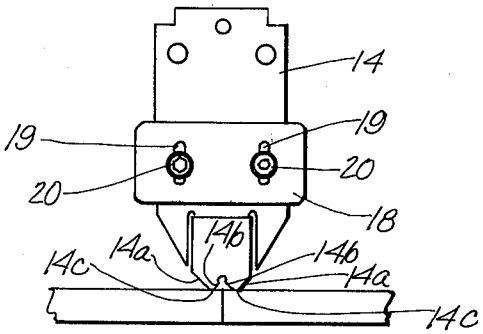
FIG. 12A shows the use of the tool to make a flat butt joint.
Figure 12B:
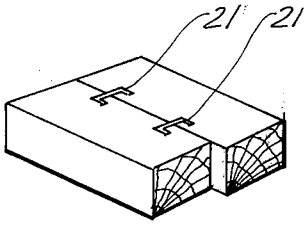
FIG. 12B shows the joint of FIG. 12A completed.

The surfaces **14*b* are also at right angles to each other and at 45° of the axis of the tool but they are inverted with respect to the surfaces 14*a*. The surfaces 14*b* are suitable for driving a clamp nail into the outside of a 45° miter joint as shown in FIGS. 9A and 9B. The surfaces 14*a* and 14*b* are preferably connected by relatively narrow flat portions 14*c* which are suitable when the tool is being used to drive a clamp nail into a flat butt joint as shown in FIGS. 12A and 12B**.

Figure 8A:
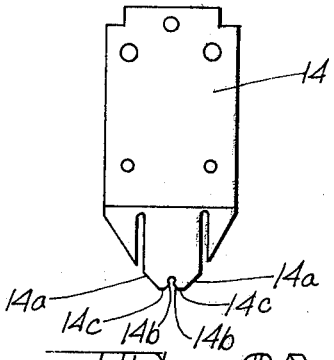
FIG. 8A is a front view of the guide body.
Figure 8B:
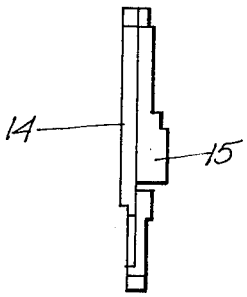
FIG. 8B is a side view thereof.
Figure 8C:
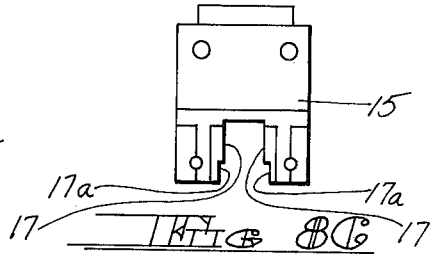
FIG. 8C is a rear view of the backing plate.
Figure 8D:
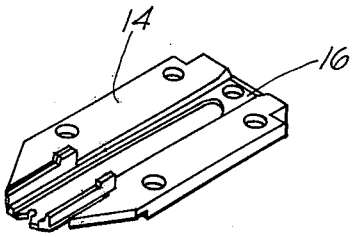
FIG. 8D is a rear perspective view of the guide body.
Figure 8E:
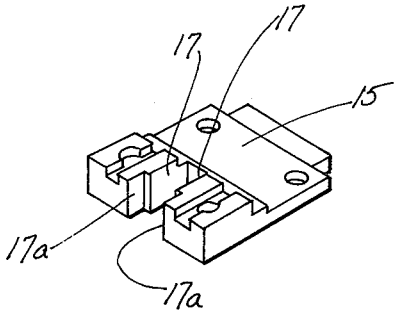
FIG. 8E is a rear perspective view of the backing plate.

FIG. 8D shows an inside view or a back view of the guide body 14 and shows the channel 16 in which the driver reciprocates and into which individual clamp nails are fed, one at a time. FIG. 8E is a perspective view of the backing plate as seen from the rear. The backing plate of FIGS. 8C and 8E is assembled to the guide body 14 in the relationship best seen in FIG. 8B. Notice should be taken of the configuration indicated at 17 and **17*a* in FIG. 8C and FIG. 8E**. The purpose of this particular configuration will be described in more detail hereinafter.

Figure 8F:
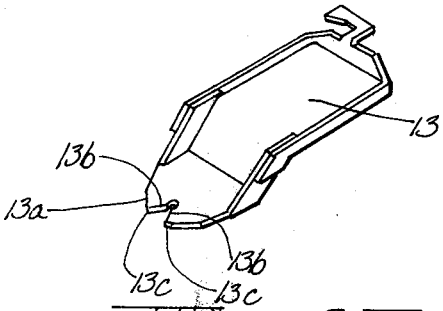
FIG. 8F is a perspective view of the safety foot.

The safety foot shown in FIG. 8F has the same configuration as indicated at **14*a*, 14*b* and 14*c* in FIG. 8A. These elements are shown in 13*a*, 13*b* and 13*c*. It will be clear as disclosed from the patents above mentioned that the nose portion of the safety 13 extends slightly below the nose portion of the guide body 14 as best seen in FIG. 1. As disclosed in the patents above mentioned, actuation of the trigger 12 will not produce a stroke of the driver unless the tool is held against the work piece and the nose portion 13*c* has been pushed up to the level of the portion 14*c*** of the guide body.

Figure 10A:
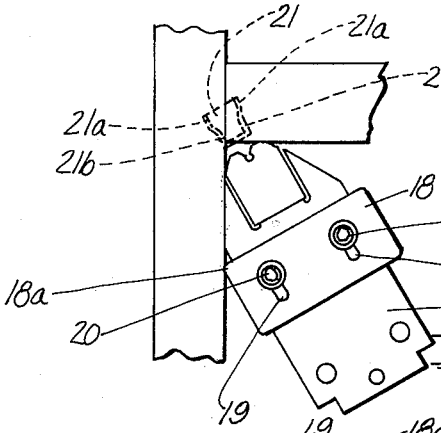
FIG. 10A is a view showing the adjustment of the plate to provide for a 30° angle to drive a clamp nail into an inside right angled butt joint.
Figure 10B:
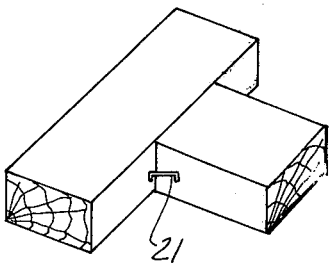
FIG. 10B is a perspective view of the joint as nailed with the tool in the position of 10A.

Secured to the front of the guide body is a plate 18. The plate has preferably a pair of slots 19 and the plate 18 is fastened to the guide body by means of Allen screws or the like at 20. As seen in FIG. 11A, when the plate 18 is adjusted to its most forward position, the corners **18*a* of the plate 14 assist in maintaining the tool at a 45° angle suitable for driving a clamp nail into an inside miter. When the plate 18 is retracted to its rearmost position as shown in FIG. 10A, the corner 18*a* assists in holding the tool at a 30° angle so as to drive a clamp nail indicated in broken lines at 21 into a position in which it has an equal grip in the two pieces which compose the inside butt joint. It is well understood in the art that if the nose piece is held at a 45° angle as in FIG. 11A** with an inside butt joint, the joint will be unsatisfactory because the bulk of the clamp nail will be in one of the two pieces and the other piece will have only a very small part of the clamp nail in it.

It will be understood that if the inside butt joint is other than at a 90° angle, the plate 18 may be adjusted to a position between its two extremes to insure proper driving of the clamp nail.

The use of the tool in making a flat butt joint is shown in FIG. 12A and it can be seen that the portions **14*c*** rest flat on the two pieces to be joined.

From FIG. 10A it can be seen how the clamp nail 21 is driven with the wider end as the leading end. It will be clear that if it were driven with the narrow end first, it would not produce a good joint. For this reason it is important that the stick of clamp nails be placed in the magazine in the correct position. This is the function of the configuration seen in FIGS. 8C and 8E and designated at 17 and **17*a*. In FIG. 8C it can be seen that the configuration is similar to the shape of the clamp nail with the portions 21*a* of the clamp nail capable of passing between the surfaces 17*a* of the plate 15 and the portions 21*b* of the clamp nail passing between the surfaces 17. Clearly if the stick of nails were inserted upside down the wider portions 21*a* could not pass between the narrower portion 17 of the plate 15**. This insures against improper insertion of clamp nails in the magazine.

Figure 2:
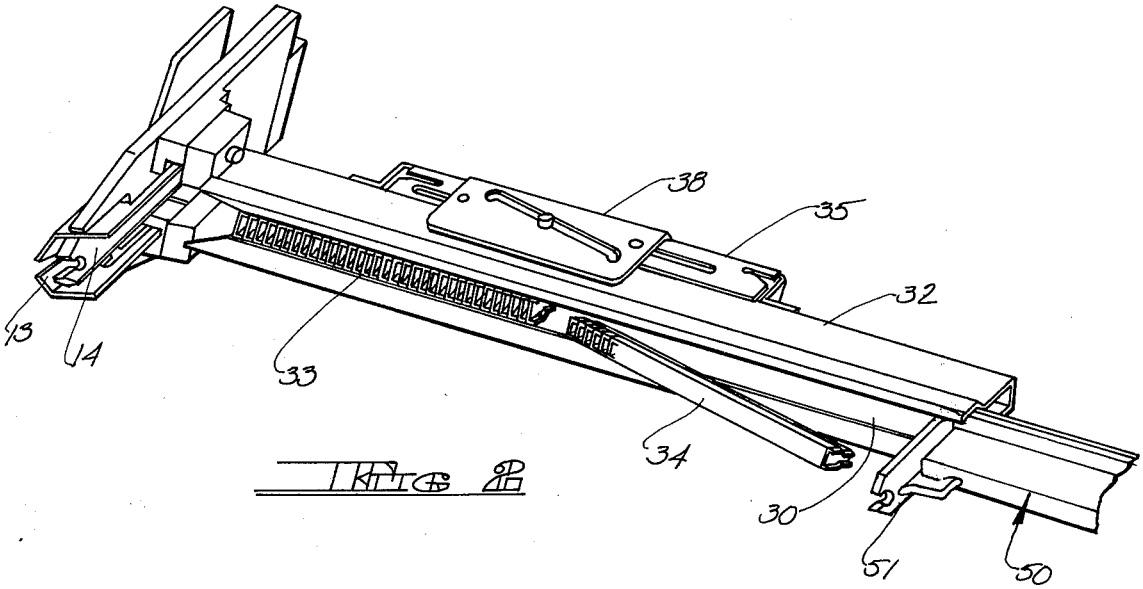
FIG. 2 is a perspective view as seen from below of the magazine portion of the tool. The tool has been omitted to improve the clarity of the drawing.
Figure 3:
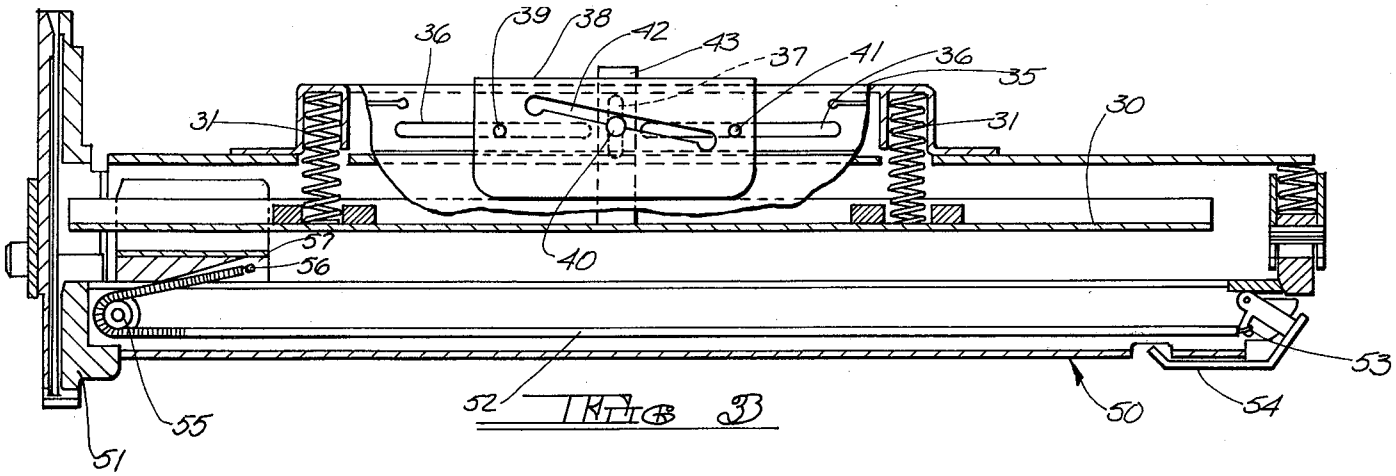
FIG. 3 is a vertical cross sectional view through the magazine.
Figure 4:
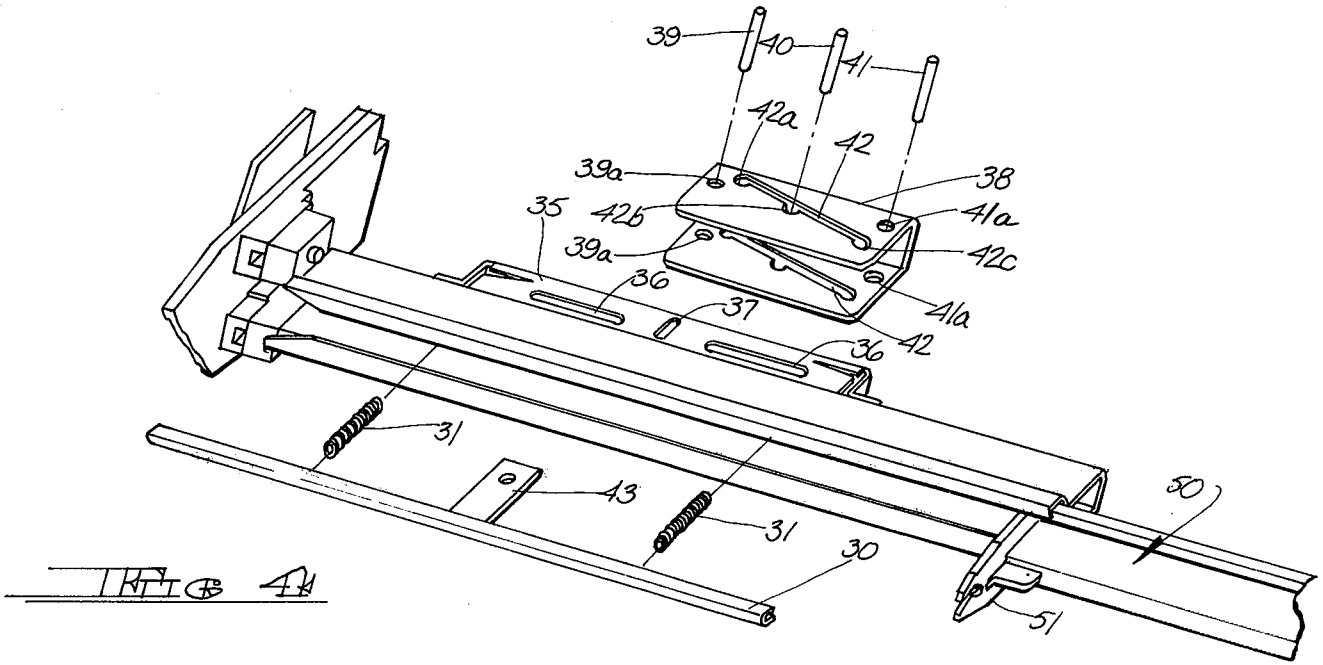
FIG. 4 is an exploded perspective view showing the adjustable rail which makes possible the use of the tool with clamp nails of different sizes.

The magazine, as indicated above, is capable of accepting clamp nails of several different sizes. In the embodiment illustrated in the drawings, the magazine can accept three different sizes of clamp nails. This is accomplished by means of a spring loaded rail 30. The rail of the illustrated embodiment is urged downward by the two compression springs 31, best seen in FIG. 3. Of course, the rail 30 could be urged downward by any suitable spring force. The magazine as a whole is generally indicated at 32. Sticks of clamps nails are indicated in FIG. 2 at 33 and 34.

Secured to the top of the magazine is a structure 35 of channel shaped cross section and each of the side walls thereof is provided with a pair of longitudinal slots 36 and the vertical slot 37. A saddle member 38 is of a size and shape to slide over the member 35 and is held in position thereon by three pins, 39, 40 and 41. The pin 39 passes through holes **39*a* in the saddle 38 and through one of the slots 36. Similarly, the pin 41 passes through the holes 41*a* in the saddle 38 and through the other slot 36. The pin 40 passes through the vertical slot 37 and through the slanting slots 42 in the saddle 38. It will be observed that there is a slot 42 on each arm of the saddle 38 and that the slots have the enlarged offset recesses 42*a*, 42*b* and 42*c***.

It will now be clear that by shifting the saddle 38 along the axis of the magazine, the pin 40 may be caused to rest in the recess **42*a* or the recess 42*b* or the recess 42*c*. Because of the slant of the slot 42, this results in causing the rail 30 to be moved upward or downward. The pin 40 is secured to the pin 43 so that as the pin 40 is moved upwardly or downwardly in the slot 42, it carries with it the pin 43 and thus the rail 30** to which it is secured.

Figures 5A, 5B, 6A, 6B, 7A, 7B:
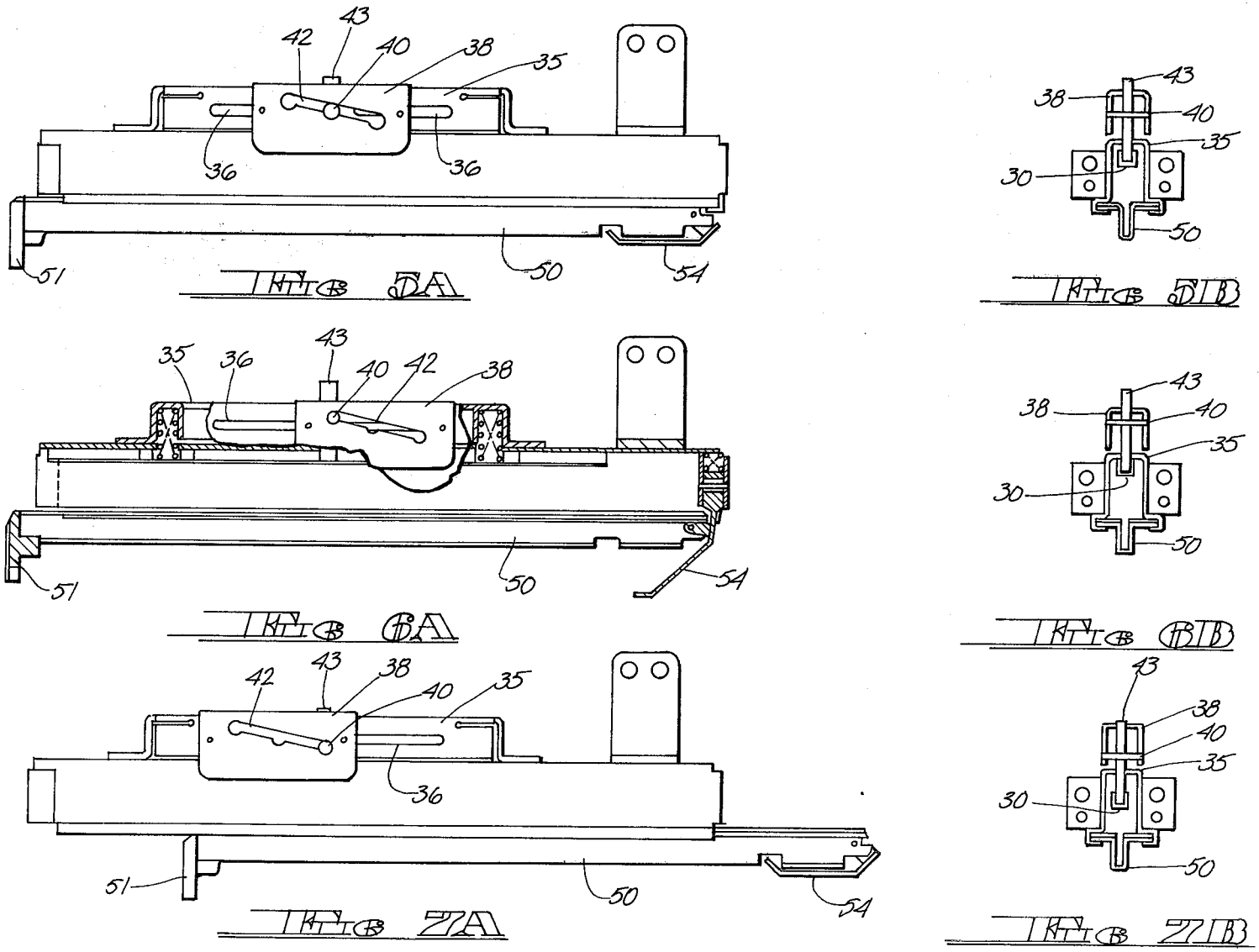
FIG. 5A is a side view of the magazine portion of the tool showing the rail adjustment in the center position.
FIG. 5B is an end view of FIG. 5A.
FIG. 6A is a cross sectional view similar to FIG. 5A showing the magazine adjusted for the longest size of clamp nail.
FIG. 6B is an end view of the magazine adjusted for the longest size of clamp nail.
FIG. 7A is a view similar to FIG. 5A showing the magazine arranged for the smallest size of clamp nail.
FIG. 7B is an end view of FIG. 7A.

The three positions of the saddle 38 and the rail 30 are best seen in FIGS. 5A and B, 6A and B and 7A and B.

Figure 8G:
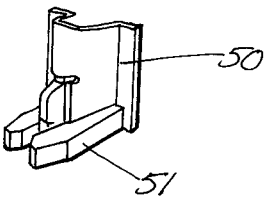
FIG. 8G is a fragmentary perspective view of the rail and anvil.

The member generally indicated at 50 serves as a cover for the magazine and also houses the follower 57 and provides an anvil 51 best seen in FIG. 8G to provide a solid member to press against the joint to be clamp nailed. The magazine cover and follower are largely conventional. A long tension spring 52 is secured at 53 to a latch lever 54. The spring passes around a small pulley 55 and is then attached at 56 to the follower block 57.

It will now be clear from the foregoing description and consideration of the drawings that a structure has been provided which makes it impossible to operate the clamp nail tool with the clamp nails in the magazine upside down. It will also be clear that the magazine may be adjusted by a simple sliding movement of the saddle member 38 to accept clamp nails of different sizes. Furthermore, it will be understood that it is unnecessary to change guide bodies in order to perform a clamp nail operation on an outside miter, or an inside miter or an inside butt joint or a flat joint. A simple adjustment of a plate secured to the guide body insures a correct angular position of the guide body for a 30° relationship in performing an operation on an inside right angle butt joint.

It will be clear that modifications may be made without departing from the spirit of the invention and no limitation is intended other than limitations specifically set forth in the claims.

The embodiments of the invention in which an exclusive property or privilege is claimed are defined as follows:

1. In a tool for driving clamp nails into work pieces having a driver element and means to cause said driver element to execute a driving and return stroke, a guide body through which said driver element moves in its stroke, a magazine for holding a stick of clamp nails, said magazine communicating with said guide body, said guide body having an aperture through which clamp nails are fed successively into position to be driven by said driver element; and aperture being configured with a relatively narrower upper portion and a relatively wider lower portion to assure that clamp nails cannot be fed through said aperture upside down, an adjustable rail in said magazine, whereby said magazine may accept several sizes of clamp nails, said guide body having a nose portion of W shape, the outer surfaces of said W being respectively at an acute angle with respect to the centerline of the tool, so as to fit into an inside corner of a mitered joint to be clamp nailed, the central inner surfaces of said W being respectively at an acute angle with respect to the centerline of the tool but inverted with respect to the outer surfaces of said W so as to fit over an outside corner of a mitered joint to be clamp nailed, narrow surfaces connecting the respective outer surfaces and central inner surfaces, said narrow surfaces being normal to the centerline of the tool for use in clamp nailing flat abutting surfaces, and a plate adjustably secured to said guide body and extending laterally therebeyond, and adjustable between a position in which it assists in positioning the tool at a 45° angle for properly clamp nailing an inside mitered joint, and a position in which it assists in positioning the tool at a 30° angle for properly clamp nailing an inside right angled butt joint.

2. In a tool for driving clamp nails into work pieces having a driver element and means to cause said driver element to execute a driving and return stroke, a guide body through which said drive element moves in its stroke, a magazine for holding a stick of clamp nails, said magazine communicating with said guide body, said guide body having an aperture through which clamp nails are fed successively into position to be driven by said driver element; said aperture being configured with a relatively narrower upper portion and a relatively wider lower portion to insure that clamp nails cannot be fed through said aperture upside down.

3. A tool according to claim 2 wherein the shape of said aperture is similar to the shape of a clamp nail when it is properly positioned for driving into a work piece.

4. In a tool for driving clamp nails into work pieces having a driver element and means to cause said driver element to execute a driving and return stroke, a guide body through which said driver element moves in its stroke, a magazine for holding a stick of clamp nails, said magazine communicating with said guide body, said guide body having an aperture through which clamp nails are fed successively into position to be driven by said driver element; an adjustable rail in said magazine, to permit said magazine to accept several sizes of clamp nails, said magazine being provided with a slidable saddle having supports engaging in slots in said magazine to permit sliding movement of said saddle with respect to said magazine, said saddle having a sloping slot, said rail having an upstanding lug and having a support extending through a hole in said lug and into said sloping slot, whereby movement of said saddle produces upward or downward movement of said lug and said rail.

5. A tool according to claim 4, wherein said sloping slot has a number of recesses into which said support may engage to hold said rail in one of several adjusted positions.

6. A tool according to claim 5, wherein a spring force is provided to urge said rail downwardly against a stick of nails in said magazine.

7. In a tool for driving clamp nails into work pieces having a driver element and means to cause said driver element to execute a driving and return stroke, a guide body through which said driver element moves in its stroke, a magazine for holding a stick of clamp nails, said magazine communicating with said guide body, said guide body having an aperture through which clamp nails are fed successively into position to be driven by said driver element; said guide body having a nose portion of W shape, the outer surfaces of said W being respectively at an acute angle with respect to the centerline of the tool, so as to fit into an inside corner of a mitered joint to be clamp nailed, the central inner surfaces of said W being respectively at an acute angle with respect to the centerline of the tool but inverted with respect to the outer surfaces of said W so as to fit over an outside corner of a mitered joint to be clamp nailed, narrow surfaces connecting the respective outer surfaces and central inner surfaces, said narrow surfaces being normal to the centerline of the tool for use in clamp nailing flat abutting surfaces, and a plate adjustably secured to said guide body and extending laterally therebeyond, and adjustable between a position in which it assists in positioning the tool at a 45° angle for properly clamp nailing an inside miter joint, and a position in which it assists in positioning the tool at a 30° angle for properly clamp nailing an inside right angled butt joint.

8. A tool according to claim 7, having a safety device comprising a work contacting element having the same configuration as the nose portion of the guide body but extending slightly beyond the nose portion of said guide body and arranged to prevent actuation of said tool until the tool is positioned against the work piece.

9. A tool according to claim 8 having a magazine cover element, said magazine cover element having an anvil portion with the same configuration as the nose portion of said guide body to assist in proper positioning of the tool for clamp nailing in the various modes.

* * * * *